US010906777B2

(12) United States Patent
Talonen

(10) Patent No.: US 10,906,777 B2
(45) Date of Patent: Feb. 2, 2021

(54) SAFETY SYSTEM FOR A SERVICE SPACE WITHIN AN ELEVATOR SHAFT

(71) Applicant: KONE Corporation, Helsinki (FI)

(72) Inventor: Tapani Talonen, Helsinki (FI)

(73) Assignee: KONE CORPORATION, Helsinki (FI)

( * ) Notice: Subject to any disclaimer, the term of this patent is extended or adjusted under 35 U.S.C. 154(b) by 591 days.

(21) Appl. No.: 15/868,456

(22) Filed: Jan. 11, 2018

(65) Prior Publication Data

US 2018/0244494 A1 Aug. 30, 2018

(30) Foreign Application Priority Data

Feb. 27, 2017 (EP) ..... 17158123

(51) Int. Cl.
*B66B 5/00* (2006.01)

(52) U.S. Cl.
CPC ..... *B66B 5/005* (2013.01); *B66B 5/0056* (2013.01); *B66B 5/0062* (2013.01)

(58) Field of Classification Search
CPC ..... B66B 5/005; B66B 5/0056; B66B 5/0062
USPC ..... 187/391
See application file for complete search history.

(56) References Cited

U.S. PATENT DOCUMENTS 3,783,976 A * 1/1974 Kerr ..... B66F 7/18 187/207
5,407,028 A * 4/1995 Jamieson ..... B66B 5/10 187/287
5,513,724 A * 5/1996 De Jong ..... B66B 5/284 187/264
5,727,657 A 3/1998 Foelix
7,287,626 B2 * 10/2007 Kigawa ..... B66B 5/282 187/344
7,832,526 B2 * 11/2010 Sirigu ..... B66B 5/0056 187/357
8,371,420 B2 * 2/2013 Kondo ..... B66B 1/32 187/288
8,408,364 B2 * 4/2013 Kangas ..... B66B 1/3492 187/393
9,272,881 B2 * 3/2016 Zhu ..... B66B 7/02
(Continued)

FOREIGN PATENT DOCUMENTS

DE 100 52 459 A1 5/2002
EP 1 110 900 A1 6/2001
(Continued)

OTHER PUBLICATIONS

European Search Report, issued in Priority Application No. 17158123.4, dated Aug. 16, 2017.

*Primary Examiner* — David S Warren
(74) *Attorney, Agent, or Firm* — Birch, Stewart, Kolasch & Birch, LLP

(57) ABSTRACT

The invention concerns a safety arrangement of an elevator facility for safeguarding a work environment in an elevator shaft by actuating an actuator ensuring that an elevator car is not moving unintentionally during a safety situation, the elevator facility having a control system to which the safety arrangement is connected. According to the invention the safety arrangement comprises hydraulic activation means including a suspended floating platform being vertically movable, under which platform a sensing hydraulic cylinder is installed for activating the actuator upon loading of the platform.

20 Claims, 2 Drawing Sheets

(56) References Cited

U.S. PATENT DOCUMENTS

Figure 1:
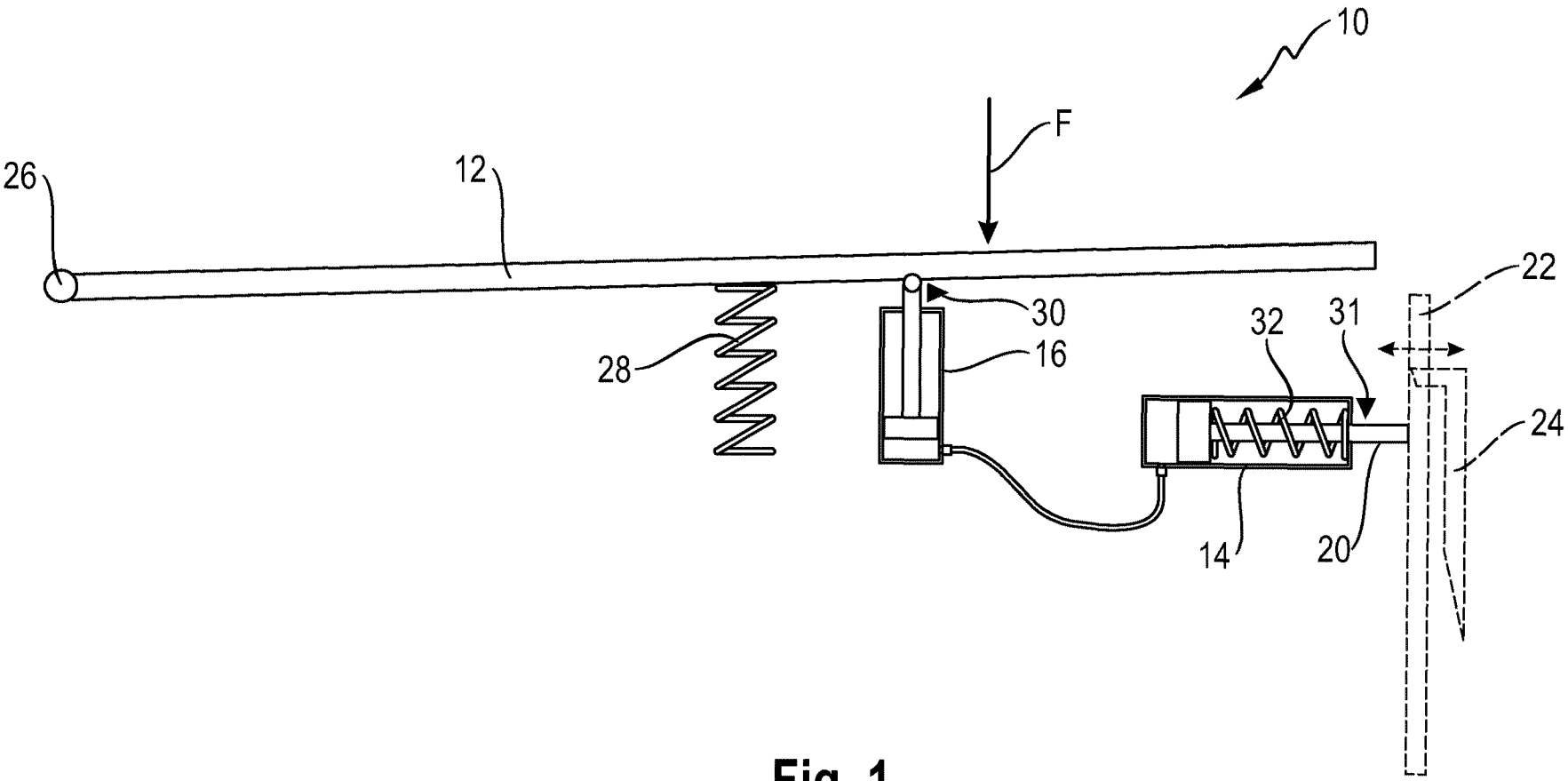

| | | | | |
|---|---|---|---|---|
| 9,412,367 | B2 * | 8/2016 | Gazdzinski | G06Q 30/0261 |
| 9,489,787 | B1 * | 11/2016 | Ives-Halperin | H04W 4/021 |
| 9,517,919 | B2 * | 12/2016 | Kalliomaki | B66B 5/282 |
| 9,710,225 | B2 * | 7/2017 | Gazdzinski | G06F 3/044 |
| 9,898,881 | B2 * | 2/2018 | Ives-Halperin | G06Q 10/02 |
| 10,282,929 | B2 * | 5/2019 | Truong | G06Q 10/0833 |
| 10,348,708 | B2 * | 7/2019 | Denker | G06Q 10/087 |
| 10,636,231 | B2 * | 4/2020 | Truong | G06Q 10/0833 |
| 10,723,590 | B2 * | 7/2020 | Qi | B66B 5/005 |
| 2002/0084148 | A1 * | 7/2002 | Nygren | B66B 5/288 187/302 |
| 2003/0217895 | A1 * | 11/2003 | Kigawa | B66B 5/282 187/344 |
| 2006/0042883 | A1 * | 3/2006 | Scott | B66B 5/005 187/351 |
| 2006/0231349 | A1 * | 10/2006 | Kigawa | B66B 5/282 187/345 |
| 2006/0249334 | A1 * | 11/2006 | Kigawa | B66B 5/282 187/344 |
| 2008/0099284 | A1 | 5/2008 | Kocher et al. | |
| 2014/0110194 | A1 * | 4/2014 | Zhu | B66B 17/04 187/254 |
| 2015/0321884 | A1 * | 11/2015 | Kalliomaki | B66B 5/06 187/247 |
| 2016/0080943 | A1 * | 3/2016 | Ives-Halperin | H04L 63/0861 713/168 |
| 2016/0142389 | A1 * | 5/2016 | Denker | H04L 63/0492 726/4 |
| 2016/0267767 | A1 * | 9/2016 | Palazzola | G08B 6/00 |
| 2017/0109132 | A1 * | 4/2017 | Gazdzinski | G06F 3/167 |
| 2017/0174474 | A1 * | 6/2017 | Aitamurto | B66B 5/005 |
| 2017/0297868 | A1 * | 10/2017 | Aitamurto | B66B 1/28 |
| 2018/0005465 | A1 * | 1/2018 | Truong | G07C 9/28 |
| 2018/0099841 | A1 * | 4/2018 | Qi | B66B 5/0018 |
| 2018/0134518 | A1 * | 5/2018 | Fauconnet | B66B 5/288 |
| 2018/0162692 | A1 * | 6/2018 | Herkel | B66B 5/0068 |
| 2018/0244494 | A1 * | 8/2018 | Talonen | B66B 5/0062 |
| 2018/0251340 | A1 * | 9/2018 | Fauconnet | B66B 5/288 |
| 2019/0077632 | A1 * | 3/2019 | Kondo | B66B 5/00 |
| 2019/0259228 | A1 * | 8/2019 | Truong | H04W 12/08 |
| 2019/0263630 | A1 * | 8/2019 | Fauconnet | B66B 13/285 |
| 2019/0322485 | A1 * | 10/2019 | Kattainen | B66B 5/02 |
| 2019/0334883 | A1 * | 10/2019 | Denker | H04L 63/08 |
| 2020/0130984 | A1 * | 4/2020 | Wang | G05B 13/048 |

FOREIGN PATENT DOCUMENTS

| | | | |
|---|---|---|---|
| EP | 1 118 574 | A2 | 7/2001 |
| EP | 1 753 688 | A1 | 2/2007 |
| EP | 1 773 704 | A1 | 4/2007 |
| EP | 2 328 826 | A1 | 6/2011 |
| JP | 2005-170565 | A | 6/2005 |
| WO | WO 2005/105644 | A1 | 11/2005 |
| WO | WO 2005/105645 | A1 | 11/2005 |
| WO | WO 2011/030325 | A1 | 3/2011 |

* cited by examiner

SAFETY SYSTEM FOR A SERVICE SPACE WITHIN AN ELEVATOR SHAFT

FIELD OF THE INVENTION

The present invention relates to an elevator system comprising a car inside an elevator shaft being driven by a corresponding drive machinery, wherein an entrance of the shaft provides access to a work environment in the elevator shaft. To this end, the elevator system includes an elevator facility a part of which is a shaft safety system for safeguarding a maintenance worker in the work environment from the car. In detail, the invention also relates to such a shaft safety system.

BACKGROUND OF THE INVENTION

Usually in elevators the car is arranged to travel up and down in an elevator hoistway, which is normally an enclosed space, to which other people than servicing employees do not have access. For machine-room-less elevators the drive unit and sometimes the control unit as well are positioned inside the shaft, in most cases in the pit or in the top of the shaft. In a servicing situation a servicing employee must possibly gain access to parts of the elevator that are situated in the hoistway, which parts can be situated at the base of the hoistway or in the top part of the hoistway (or somewhere between them). Persons that enter a hoistway, such as elevator mechanics and building maintenance stuff may suffer serious and fatal accidents when the elevator moves towards the overhead or the pit in case the movement of the car underruns the dimensions for a free movement of the person. Such accidents can also occur in a sudden movement of the elevator car. This problem is aggravated in systems in which there is no machine room but the hoisting machine and/or the controller are located in the pit or overhead construction. As architects continue to try to reduce the size of the overhead and the depth of the pit, the problem becomes even worse. The same is true when modernizing the elevators of old buildings since problems are often encountered when the headrooms and bottom clearances in the elevator shaft above and below the car are not large enough to meet the requirements of modern safety regulations. In a servicing situation the elevator car must be driven to a suitable location, depending on which point in the hoistway the servicing procedures must be carried out. For example, if servicing procedures are needed at the base of the hoistway, the car must be driven sufficiently upwards in such a way that there is access to the base of the hoistway from the bottommost floor level. If servicing is needed in the top part of the hoistway, the car can be driven to a suitable height in such a way that from the topmost floor level it is possible to perform the servicing procedures from the roof of the car. When servicing procedures are being performed in the elevator hoistway, the safety of servicing employees must be ensured. As elucidated above, if an elevator car is near a servicing employee during servicing, unexpected movement of the car can then cause a dangerous situation. This type of situation can also occur when parts on the base of the elevator car or on the bottom part of the car are serviced in such a way that the servicing employee is on the base of the elevator hoistway. The elevator car must not therefore start moving during servicing or if for some reason it starts to move it must be brought to stop quickly. The size of the safe working space, i.e. the distance of the car from the bottom end or from the top end of the elevator hoistway, is also defined in elevator regulations.

To this end, the safety space is to be "activated" thus making the elevator hoistway a safer working space. Particularly in solutions in which the safety system is switched on by remote control, it may be unclear to a servicing employee whether the safety system is reliably activated. Known solutions for arranging a temporary safety space in an elevator hoistway are presented e.g. in publications US2008099284A1, EP1118574A2, EP1110900A1 and U.S. Pat. No. 5,727,657A. The standard shaft safety system complying with EN81 incorporates buffers for the car and counterweight to limit their lowest elevation in the hoistway and a pit stopping device to prevent a car operation when active. The buffers, rubber bumpers, spring or hydraulic buffers, safeguard a specified refugee space. A standard procedure is to activate the pit stopping device before entering the pit and deactivating it again after leaving. The operation of the pit stopping device is by manual action, so it can be easily forgotten or even neglected. To reach the parts installed underneath the car after pit entrance, car operation from the pit may be required to lower the car for testing or maintenance performance to these parts. This will lead to unauthorized deactivation of the pit stopping device when present in the pit or climbing on top of something to reach the higher parts which results into an unsafe work environment.

In summary, activation and resetting of the safety space, i.e. the headroom and/or pit by mechanical linkage and/or wire can be difficult and not totally reliable: The linkage needs to be tailored for different platform dimensions. Unintended activation can take place at any emergency braking situation. Resetting by wire from a Maintenance Access Panel can be carried out even if somebody still is on the car roof. Further, earlier solutions are based mainly on a mechanical linkage between a vertically moving platform and a mechanical actuator activation making them complicated and difficult to implement for flexible car/pit sizes. Mechanical systems based on springs are unreliable, if the load is fluctuating. Also they are sensitive e.g. in emergency braking situations and a mechanical linkage is needed to adjust on platform size.

AIM OF THE INVENTION

The object of the invention is to achieve an inexpensive and easy-to-implement elevator having a safety arrangement that enables the reliably safe performance of servicing jobs in the elevator hoistway regardless of whether the object of the servicing work is in the bottom-end or in the top-end of the elevator hoistway.

SUMMARY OF THE INVENTION

The above object is achieved by a solution according to one of claims 1 to 16. Advantages embodiments are disclosed in the respective subclaims.

According to the present invention a shaft safety system is provided that is at least activated automatically as soon as the car roof or pit floor is loaded as for example by a serviceman. It provides a safe work environment in the shaft that involves a safeguarded free work height as soon as the shaft safety system is active.

With the basic idea of the invention a hydraulic activation of the safety space is provided by means of a floating platform a serviceman has to walk on automatically and unknowingly for carrying out his work. According to the invention there is a hydraulic transmission of an activation force between an elevator maintenance working area platform and a safety device. Further, the platform is vertically moving when it is loaded or unloaded (e.g. by a service technician). The platform can be fixed by a levered suspension by being hinged about a pivot. The pivot may be advantageously lying at or outside of a rim of the platform. Alternatively, the platform can be floating on a compressive material or springs. As an advantageous embodiment, the moving distance of the platform can be adjusted in response to the amount of load.

Under the platform there is one or more one direction hydraulic cylinders compressed when the platform is loaded. Compressed cylinders are connected by a hydraulic line to another one-direction hydraulic cylinder, advantageously with a return spring (one or more), generating a safety device activation movement. In detail, under the platform there is a master cylinder and a slave cylinder actuating the safety device.

Resetting can be implemented by different ways. A return spring in the slave cylinder can be provided for an automatic resetting when there is no more load on the platform, or by a hydraulic pump used remotely e.g. from a landing or a Maintenance Access Panel. In the latter case there can be a one-way valve for circulating the hydraulic fluid in a closed loop when there is still a load on the platform, thus preventing unintended or premature resetting. The hydraulic pump is therefore able to reset the safety arrangement by returning the cylinder(s) back on their starting position.

According to an advantageous embodiment there is provided a non-return valve in the loop preventing return flow from the actuator. Further, the non-return valve may include a closing spring which is able to help resetting the valve.

In the result, the safety device reset can be made a) by means of an automatic reset with a single acting hydraulic cylinder with a spring return in the safety device activation cylinder (the platform is returning automatically when load is removed for example the serviceman is stepping away from the platform);

b) by means of a manual reset. When the platform is loaded, the safety device activation cylinder is activated through a non-return valve with or without a closing spring. Reset occurs by a hydraulic pump, which is resetting the safety system by returning the cylinders back to their normal position;

c) or at least alternatively, by means of an electrical device resetting the safety arrangement by returning cylinder (s) back on their starting position.

Therewith, the invention provides a feasible way to implement a safety system which will be either activated and reset automatically or activated automatically but reset manually.

The safety device activation cylinder can be located:

1. On the elevator car, e.g. for moving an activation part fixed at a safety gear rod or over speed governor rope, so that the activation part is interconnecting with a mechanical stopping element on shaft side;
2. Or at the elevator shaft site, e.g. a cylinder is moving horizontally to the mechanical stopping element to activate safety gears by the same method as in option 1.

When saying that the stopping element can activate the safety gear, this can be accomplished via an overspeed governor rope which then prevents movement of the car, or alternatively via actuating a safety gear linkage which prevents said movement by directly retaining the car in the shaft.

In an advantageous embodiment, safety switches are integrated into hydraulic cylinders so that:

1. Under the platform there is a (normally closed) switch opening the safety circuit when the platform is moving vertically due to a load. By means of such a switch for example, a signal can be sent to a control system when being triggered by a movement of the platform.
2. In the safety device activation part there is a (normally open) switch controlling the safety device activation, i.e. closing service drive/shaft access monitoring circuit, when the safety device is activated. This switch also is able to for example send a triggering signal to the control system.

The same system is feasible to be applied both in an elevator pit and/or on a car roof. The system provides a simpler and reliable way to implement a linkage between a loaded and unloaded platform movement and a mechanical safety device activation. Therewith, an easy accommodation for any platform size is a clear benefit of the present invention. The one-size-fits-all hydraulic package can be manufactured in a plant beforehand and delivered to the site or fitter as one component tested and being then ready for installation. Low/No Headroom solutions are currently very relevant and the same idea is also applicable in the pit.

According to a special embodiment no car operation enabled from another location than the relevant shaft location, e.g., pit or top of the shaft, is possible. More particularly, in case of the pit, the free work height can be overruled from the pit operation panel to reach the lower parts of the car but only by means of a certain conscious action. Preferably, the control system will allow car movement by inspection speed only.

Embodiments of the invention are shown in the figures and they are explained in the following description.

Figure 2:
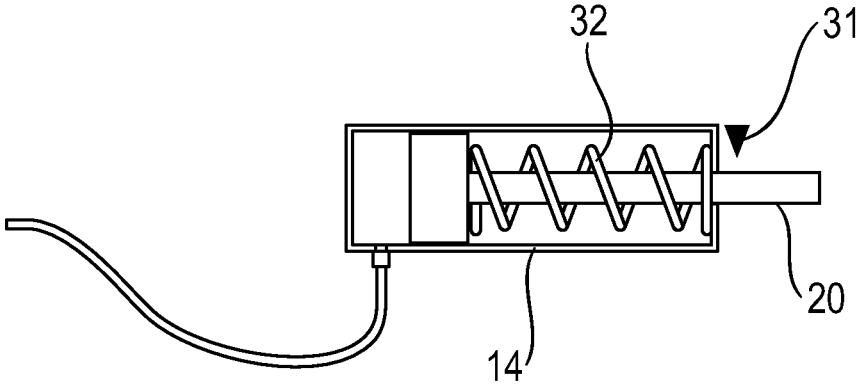
Figure 3:
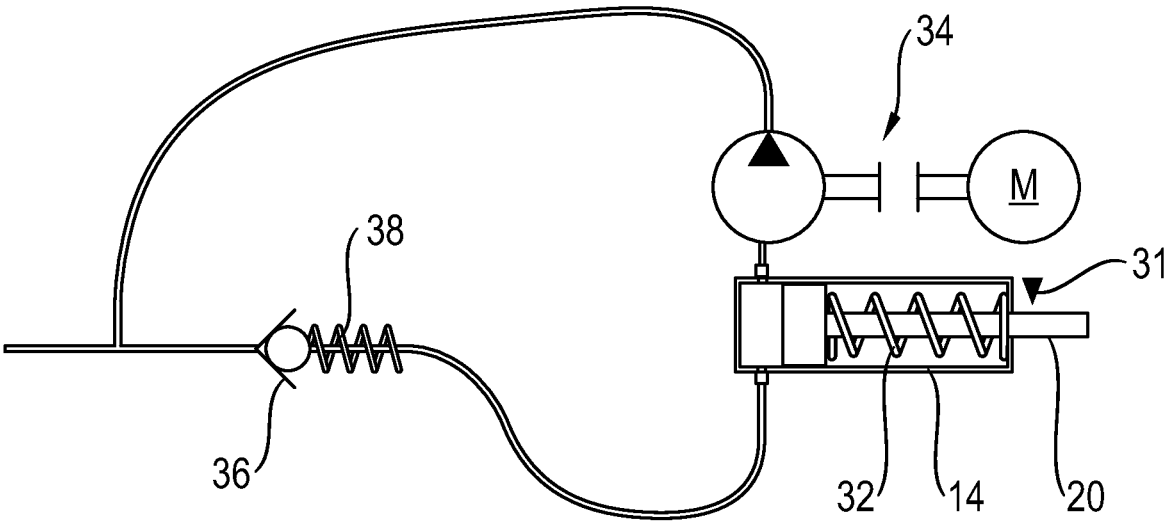

FIG. 1 shows a schematic view of a safety arrangement,
FIG. 2 shows a schematic view of a safety device, and
FIG. 3 shows a schematic view of a further safety device.

DESCRIPTION OF EMBODIMENTS

FIG. 1 shows a schematic view of a safety arrangement 10 of an elevator facility. The safety arrangement 10 is capable of safeguarding a work environment in an elevator shaft. The safety arrangement 10 comprises a suspended platform 12 that is levered pivotally by being hinged about a pivot 26 lying at or outside of a rim of the platform 12. Therewith the suspended platform 12 is vertically movable upon loading the platform 12 for example by a servicing employee entering the platform 12 and causing a force F.

Under the platform 12 a hydraulic activation means in form of a sensing hydraulic cylinder 16 is arranged. The sensing hydraulic cylinder 16 is connected to an actuator 14, comprising a rod 20 for bringing an activation part 22 into engagement with a stopping element 24. Caused by the engagement between the activation part 22 and the stopping element 24 an elevator car (not shown) cannot move vertically in the elevator shaft.

The actuator may move a mechanical detent that has a counterpart fixed to the shaft wall or other stationary structure, or it may be mechanically connected to the safety gear linkage.

Further, the actuator can actuate the elevator safety gear either by mechanical linkage or by stopping the overspeed governor rope. In the latter case, the overspeed governor rope would correspond to the activation part 22 in FIG. 1.

Additionally, the platform 12 is supported by a spring 28 to adjust the moving distance of the platform 12 in response to the amount of a load and to adjust the activating force for the actuator 14. The spring 28 is arranged under the platform 12 adjacent the sensing hydraulic cylinder 16.

The sensing hydraulic cylinder 16 comprises a safety switch 30 that is capable of sending a signal to a control system when being triggered by a movement of the platform 12.

The actuator 14 is formed as a hydraulic cylinder which also comprises a safety switch 31 that is capable of sending a signal to the control system when being triggered by a movement of the platform 12 and respectively when being triggered by a movement of the rod 20 activated by the sensing hydraulic cylinder 16 engaging the activation part 22 with the stopping element 24.

Further the actuator 14 comprises a return spring 32 to disengage the activation part 22 and the stopping element 24 bringing the actuator 14 to its original position.

FIG. 2 shows a schematic view of the actuator 14. The actuator 14 comprises the rod 20 capable of engaging the activation part 22 with the stopping element 24, the safety switch 31 capable of sending a signal to the control system when being triggered and the return spring 32 capable of disengaging the activation part 22 and the stopping element 24 bringing the actuator 14 to its original position.

FIG. 3 shows an alternative embodiment according to the invention with the actuator 14 and a hydraulic pump 34, operated by electronical motor or hand pump M, for resetting the safety arrangement 10 by resetting the actuator 14 and the sensing hydraulic cylinder 16 back to the starting position. Further, the embodiment comprises a non-return safety valve 36 with a closing spring 38 in the hydraulic line activating the actuator 14 and a hydraulic line for return flow.

REFERENCE NUMERALS

10 safety arrangement
12 platform
14 actuator
16 hydraulic cylinder
20 rod
22 activation part
24 stopping element
26 pivot
28 spring
30/31 safety switch
32 return spring
34 hydraulic pump
36 non-return valve
38 closing spring

The invention claimed is:

1. A safety arrangement of an elevator facility for safeguarding a safety space in an elevator shaft by operating an actuator ensuring that an elevator car is not moving into the safety space, the elevator facility having a control system to which the safety arrangement is connected, wherein the safety arrangement comprises hydraulic activation means including a suspended floating platform being vertically movable, under which platform a sensing hydraulic cylinder is installed for operating the actuator upon loading of the platform.

2. The safety arrangement according to claim 1, wherein said actuator is a hydraulic cylinder moving therewith an activation part for engagement with a stopping element.

3. The safety arrangement according to claim 2, wherein said stopping element is a stopping block installed as stationary in relation to a height of the shaft wall.

4. The safety arrangement according to claim 2, wherein said stopping element activates an elevator car safety gear.

5. The safety arrangement according to claim 1, wherein the platform is levered pivotally by being hinged about a pivot lying at or outside of a rim of the platform.

6. The safety arrangement according to claim 1, wherein the platform is suspended in a floating manner on compressive means.

7. The safety arrangement according to claim 1, wherein the platform is supported by a spring by means of which the moving distance of the platform can be adjusted in response to the amount of load.

8. The safety arrangement according to claim 1, wherein a safety switch is integrated into the hydraulic activation means, so that when being triggered by a movement of the platform it sends a signal to the control system.

9. The safety arrangement according to claim 1, wherein the hydraulic sensing cylinder and/or the actuator is/are single acting cylinder(s).

10. The safety arrangement according to claim 1, wherein the actuator is provided with a return spring.

11. The safety arrangement according to claim 1, wherein the hydraulic activation means comprises a hydraulic pump resetting the safety arrangement by returning cylinder(s) back on starting position.

12. The safety arrangement according to claim 11, wherein via the pump and the actuator there is a loop circulating the hydraulic fluid until load is removed from the platform.

13. The safety arrangement according to claim 12, wherein there is provided a non-return valve in the loop preventing return flow from the actuator.

14. The safety arrangement according to claim 13, wherein the non-return valve includes a closing spring.

15. The safety arrangement according to claim 1, wherein the hydraulic activation means comprises electrical means resetting the safety arrangement by returning cylinder(s) back on starting position.

16. An elevator system having the safety arrangement according to claim 1.

17. The safety arrangement according to claim 2, wherein the platform is levered pivotally by being hinged about a pivot lying at or outside of a rim of the platform.

18. The safety arrangement according to claim 3, wherein the platform is levered pivotally by being hinged about a pivot lying at or outside of a rim of the platform.

19. The safety arrangement according to claim 4, wherein the platform is levered pivotally by being hinged about a pivot lying at or outside of a rim of the platform.

20. The safety arrangement according to claim 2, wherein the platform is suspended in a floating manner on compressive means.

* * * * *